US011105078B2

(12) United States Patent
McCauley

(10) Patent No.: US 11,105,078 B2
(45) **Date of Patent: *Aug. 31, 2021**

(54) SELF-SEALING DRAIN VENT COVER

(71) Applicant: John McCauley, Philadelphia, PA (US)

(72) Inventor: John McCauley, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/746,716

(22) Filed: Jan. 17, 2020

(65) Prior Publication Data

US 2020/0149256 A1 May 14, 2020

Related U.S. Application Data

(63) Continuation-in-part of application No. 16/195,563, filed on Nov. 19, 2018, now Pat. No. 10,570,593, which is a continuation-in-part of application No. 29/658,777, filed on Aug. 2, 2018, now Pat. No. Des. 912,783.

(51) Int. Cl.
*E03C 1/24* (2006.01)

(52) U.S. Cl.
CPC ..... *E03C 1/24* (2013.01); *E03C 2001/2413* (2013.01)

(58) Field of Classification Search
CPC ..... E03C 1/24; E03C 2001/2413
USPC ..... 4/255.07
See application file for complete search history.

(56) References Cited

U.S. PATENT DOCUMENTS

| | | | | |
|---|---|---|---|---|
| 4,683,579 | A * | 7/1987 | Wardlaw | G01N 21/5911 250/338.4 |
| 5,273,077 | A * | 12/1993 | Oropallo | E03C 1/24 138/89 |
| 6,883,546 | B1 * | 4/2005 | Kobylinski | F16L 55/1141 138/89 |
| 7,891,027 | B2 * | 2/2011 | Mooney | E03C 1/24 4/255.07 |
| 9,339,150 | B1 * | 5/2016 | Risko | A47K 1/14 |
| 10,570,593 | B1 * | 2/2020 | McCauley | E03D 9/00 |
| 2002/0032926 | A1 * | 3/2002 | Lewis | E03C 1/24 4/680 |

* cited by examiner

*Primary Examiner* — Huyen D Le

(57) ABSTRACT

A self-sealing drain vent cover that allows for a vacuum to be created within piping of a plumbing fixture for unclogging purposes. The vent cover includes a outer cover and a seal insert. The outer cover includes a first tubular body and a first disk top to yield a closed off structure to support the seal insert. The first disk top is terminally and perimetrically connected to the first tubular body. The seal insert adheres to a surface around an overflow port to enclose said port. The seal insert includes a second tubular body, a second disk top, and an annular self-sealing mechanism. The second disk top is terminally and perimetrically connected to the second tubular body. The seal insert is mounted within the outer cover. The self-sealing mechanism is positioned adjacent to a bottom end of the second tubular body and is concentrically mounted to the second tubular body.

11 Claims, 6 Drawing Sheets

SELF-SEALING DRAIN VENT COVER

The current application is a continuation-in-part (CIP) application of the U.S. non-provisional application Ser. No. 16/195,563 filed on Nov. 19, 2018.

FIELD OF THE INVENTION

The present invention generally relates to plumbing equipment. More specifically the present invention is a seal designed to facilitate the plumbing process by providing additional protection for the user when removing objects that obstruct drainage systems.

BACKGROUND OF THE INVENTION

Plumbing systems of various purposes are commonly integrated in modern households. Plumbing originated during ancient civilizations and is considered by historians as a critical factor that led to development of modern civilizations. Numerous systems rely on plumbing networks including water supply, and sewage systems. Plumbing systems rely on the flow of fluids, and as such if obstructions occur the efficient operation of the system is compromised hindering functionality. In household applications one of the most common tools that may be used to clear an obstruction in a pipe is a plunger. Different types of plunger designs are available for different applications; however, the general components of a plunger include a suction cup like flange constructed out of a flexible and pliable material such as rubber, attached to a rod or handle. A conventional bathroom usually includes facilities such as wash bowls, showers, and toilets. Obstructions may occur in any of the equipment mentioned, especially after lengthened usage. A plunger is commonly used to remove the obstructions, retuning the system to a free-flowing state. Another alternative to unclogging a network of pipes is using chemicals that can dissolve the obstructing deposits through chemical reactions. However, these chemicals can be hazardous for both the user and the environment.

Sinks and bathtubs usually comprise overflow ports, designed to prevent flooding if the user accidentally leaves the water supply turned on. The overflow port is connected to the drain pipe. When plunging a sink or a bathtub, the overflow port must be covered to ensure a vacuum environment is maintained in the system. If the overflow port is not covered, sewage overflow may be forced upward through the port when pressure is applied by the plunging tool, resulting in an unpleasant experience for the user.

The present invention aims to solve this particular problem by disclosing a cover specifically designed to prevent overflow backsplash. Specifically, the present invention is a self-sealing cover specifically designed for drain vents, to facilitate the process of clearing a plumbing system. The present invention directs the pressure exerted by a plunger to the face of a drain clog rather than allowing the overflow runoff to escape through the drain vent. The present invention is versatile and allows users to use the device on drain clogs of various sizes and shapes. The assembly is simply placed over existing overflow cover, and due to the self-sealing design, operation does not require the constant input of the user.

DETAIL DESCRIPTIONS OF THE INVENTION

All illustrations of the drawings are for the purpose of describing selected versions of the present invention and are not intended to limit the scope of the present invention.

Traditionally plunging a plumbing system requires a user to manually seal the overflow port, also known as a drain vent, while applying pressure to ensure enough vacuum is created to dislodge any obstructions within the plumbing system, making the process difficult and unpleasant. The present invention allows for the user to easily seal the opening without the need to constantly hold one hand over the drain vent to create a vacuum environment within the plumbing system, further aiding in the clearing of clogged piping within the pluming system. Additionally, the present invention covers and seals the drain vent such that during plunging no waste is expelled through the drain vent as backsplash. It is understood that various customizations may be made to the assembly, to adapt the device to drain vents of various shapes and sizes without departing from the scope of the invention, and as such the device is not limited to one specific embodiment.

Figure 1:
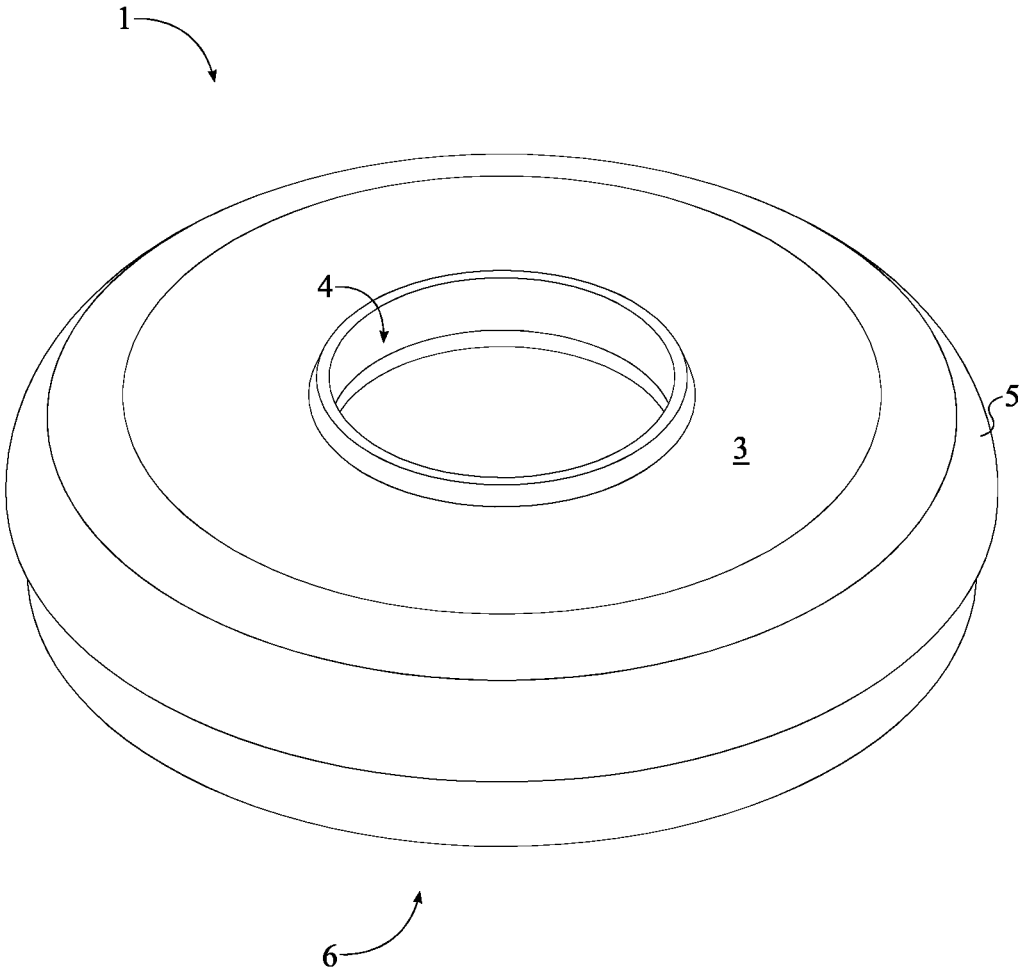
FIG. 1 is a perspective view of the present invention.
Figure 2:
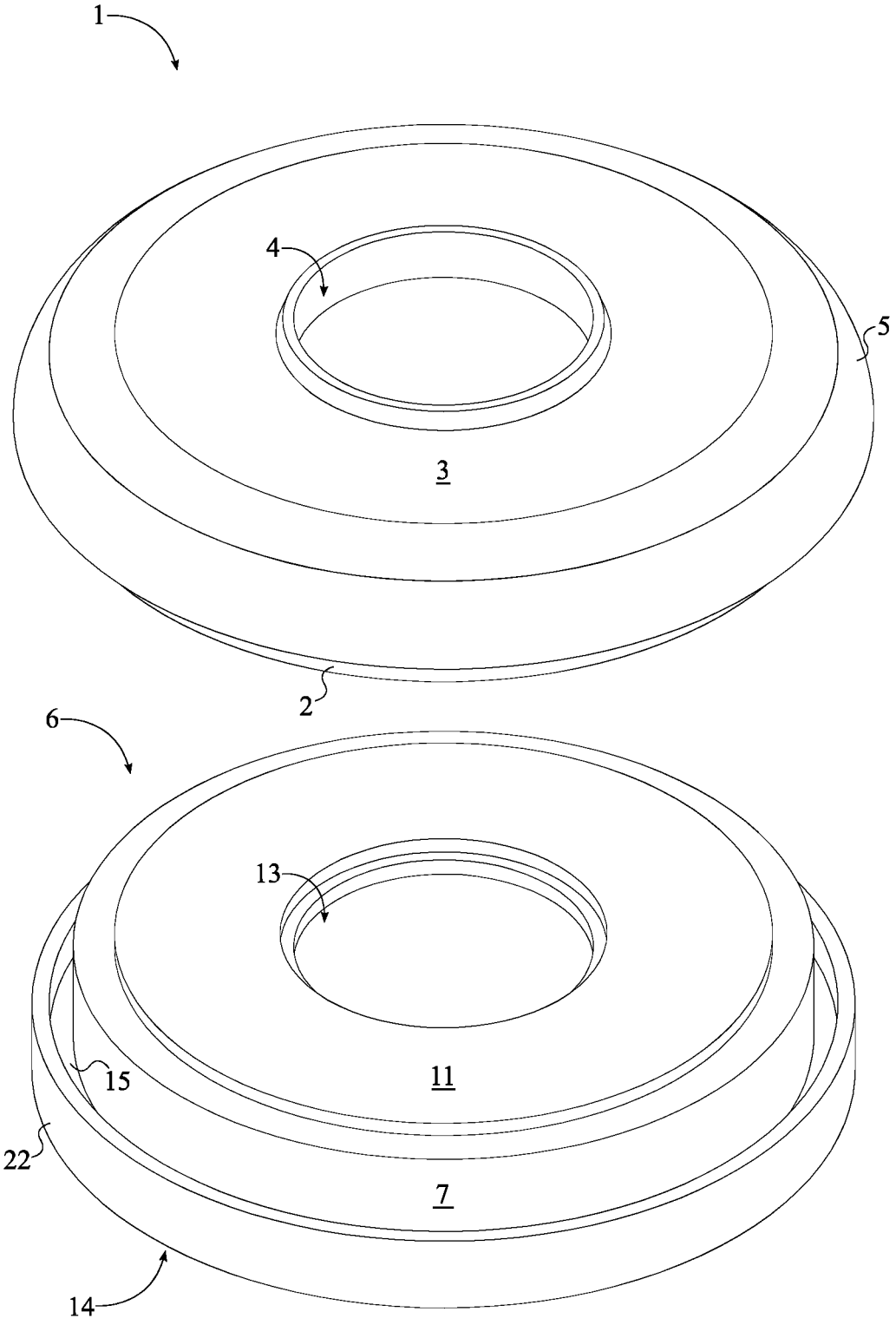
FIG. 2 is a perspective view of the present invention in an exploded state.
Figure 6:
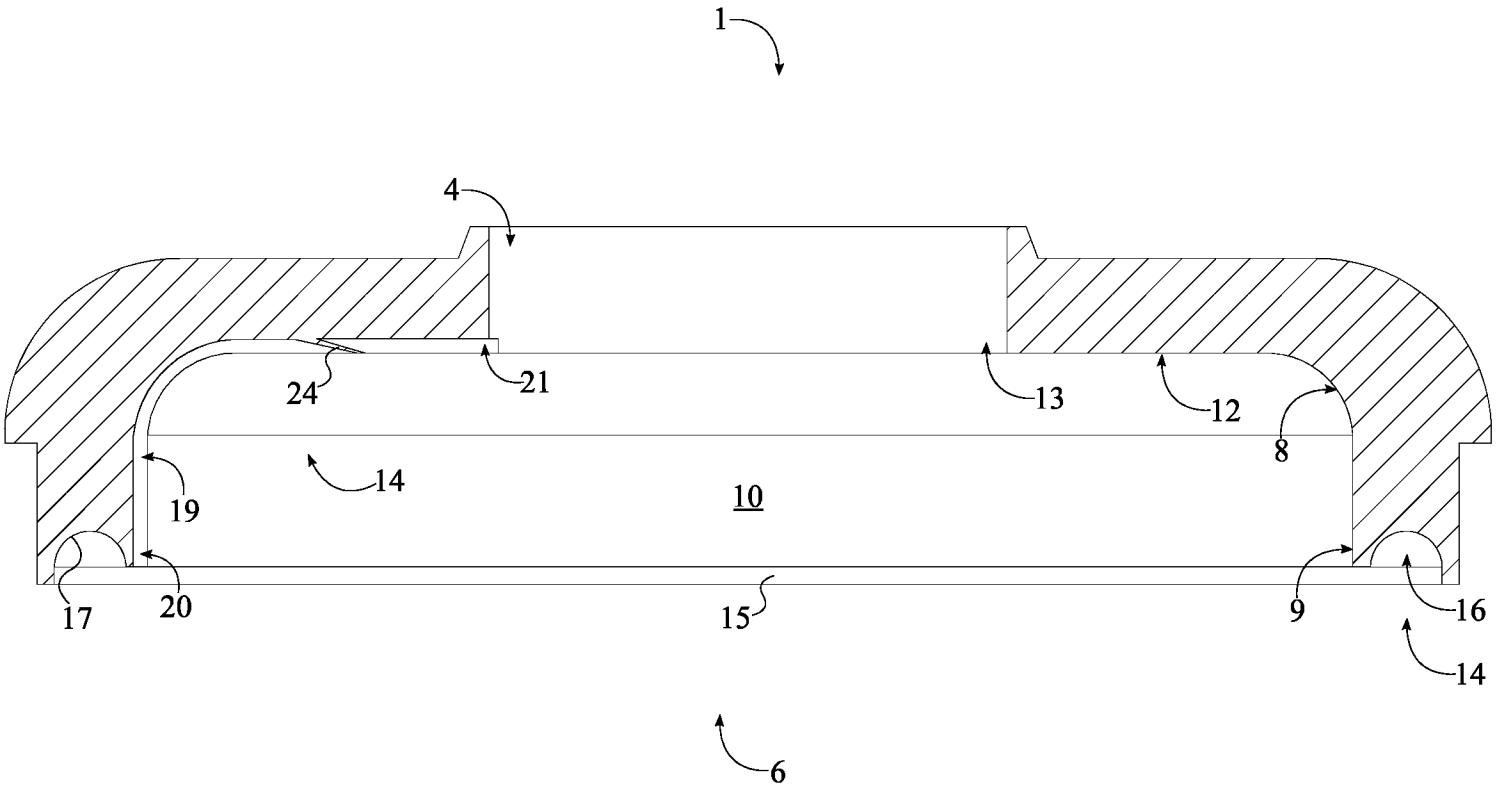
FIG. 6 is a cross-sectional view of the present invention, wherein the present invention features a contiguous material construction.

Referring to FIG. 1 and FIG. 2, in the simplest embodiment, the present invention comprises an outer cover 1 and a seal insert 6. The outer cover 1 houses and protects the seal insert 6 as well as provides structural support to the present invention such that a proper seal may be formed about the drain vent. It is further considered that the outer cover 1 may comprise a partially or wholly flexible material such that the present invention may be more effectively deployed to a variety of surfaces and plumbing installations. More specifically, the outer cover 1 comprises a first tubular body 2 and a first disk top 3. The first disk top 3 closes off one end of the first tubular body 2 to delineate an interior cavity for the seal insert 6. The seal insert 6 is preferably composed of flexible material, although may also be composed of rubber, elastomer material, or malleable material. The first disk top 3 is terminally and concentrically positioned with the first tubular body 2. Additionally, the first disk top 3 is perimetrically and adjacently connected to the first tubular body 2 to form a bowl-shaped structure. The tubular structure of the outer cover 1 is designed to accommodate a variety of standard drain vent designs. The outer cover 1 allows the user to easily grasp and install the present invention. Additionally, the outer cover 1 provides the necessary structural support for the present invention to withstand forces created through plunging or other similar cleaning methods. As such, the outer cover 1 is preferably composed of a resilient material; such materials include, but are not limited to, rubbers, polymers, metals, or any hybridized construction thereof. In reference to FIG. 6, the preferred embodiment of the present invention will see the outer cover 1 and the seal insert 6 as a permanently bonded structure, including specific contemplation of an embodiment wherein the outer cover 1 and the seal insert 6 comprise a single, contiguously formed material.

Figure 3:
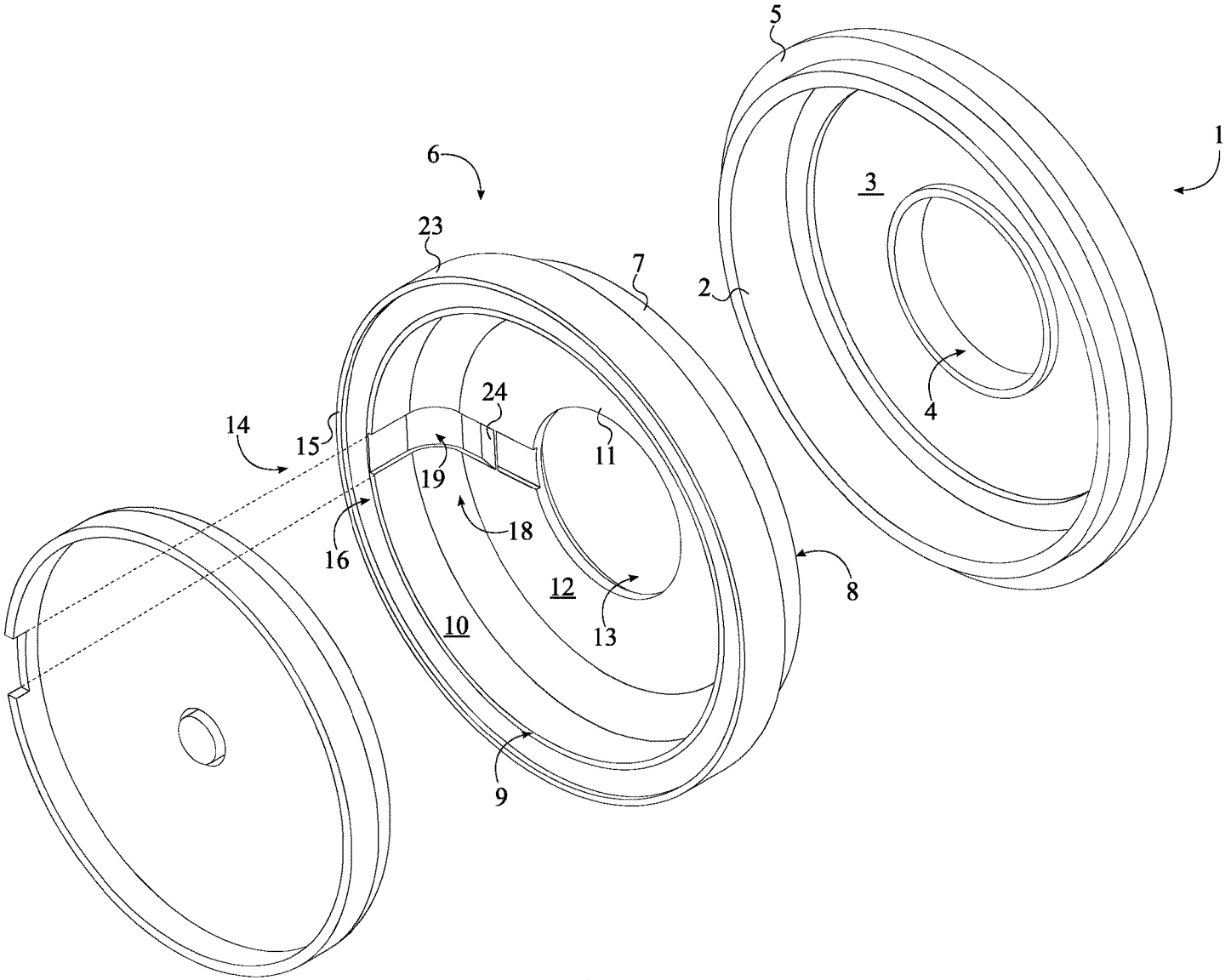
FIG. 3 is an alternative view of the present invention in an exploded state with a drain cover.

The seal insert 6 physically encloses the drain vent and attaches to a surrounding surface of the drain vent to create a vacuum seal for the plumbing system. The seal insert 6 comprises a second tubular body 7, a second disk top 11, and an annular self-sealing mechanism 14. The second tubular body 7 and the second disk top 11 are shaped, sized, and designed to complimentary fit within the interior cavity of the outer cover 1. Specifically, the second disk top 11 is terminally and concentrically positioned within the second tubular body 7. Additionally, the second disk top 11 is perimetrically and adjacently connected to the second tubular body 7. Resultantly, similar to the outer cover 1, the seal insert 6 is a bowl-shaped structure, wherein an interior cavity of the seal insert 6 receives the drain vent in entirety. The seal insert 6 is mounted to the outer cover 1 as seen in FIG. 2 and FIG. 3. The second disk top 11 is positioned parallel and adjacent to the first disk top 3. Additionally, a top end 8 of the second tubular body 7 is concentrically positioned within the first tubular body 2. It is preferred that the second tubular body 7 and the second disk top 11 are composed of rubber or rubber-like material to allow the seal insert 6 to deform against the surrounding surface and form a suction-like seal. Type of materials includes, but is not limited to, silicon, rubber, and or combination of elastic polymers to name a few non-limiting examples. In one embodiment of the present invention, the seal insert 6 is permanently integrated into the outer cover 1 during the manufacturing process. In alternative embodiments, various attachment methods may be used to mount the seal insert 6 to the outer cover 1 including, but not limited to bolts, screws, adhesives, and other similar fasteners.

The annular self-sealing mechanism 14 secures the present invention to the surrounding surface through a peripheral air-tight engagement. For reference, the surrounding surface may be the surface of a bath tub, a sink, and other similar plumbing fixtures. The annular self-sealing mechanism 14 is positioned adjacent to a bottom end 9 of the second tubular body 7. Additionally, the annular self-sealing mechanism 14 is concentrically mounted to the second tubular body 7. To ensure that the annular self-sealing mechanism 14 forms an air-tight seal, the bottom end 9 of the second tubular body 7 and the annular self-sealing mechanism 14 are configured to partially extend past and out of the first tubular body 2. Resultantly, when the present invention is attached, the annular self-sealing mechanism 14 engages the surrounding surface first.

Figure 4:
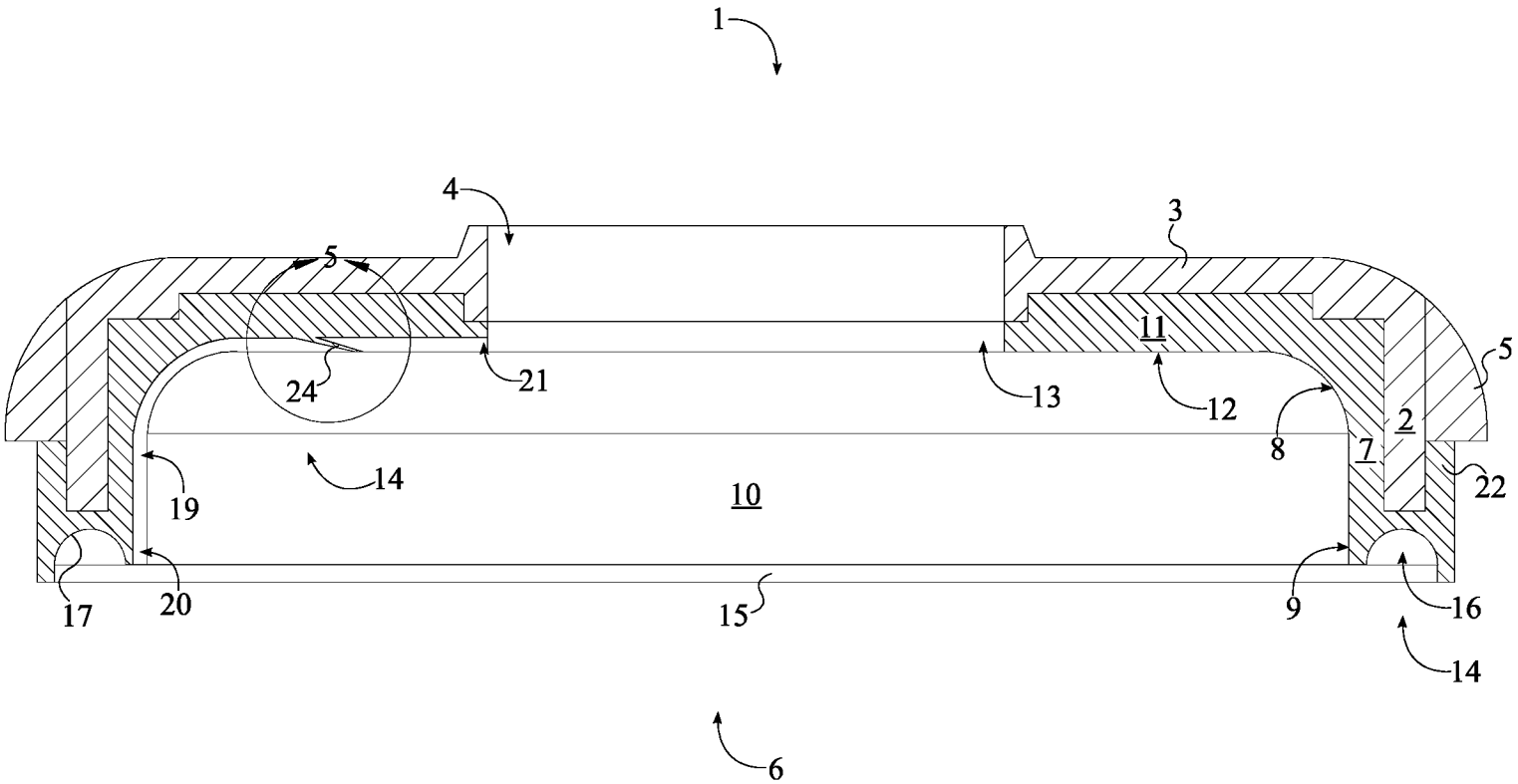
FIG. 4 is a cross-sectional view of the present invention.

In the preferred embodiment of the present invention, the annular self-sealing mechanism 14 is a double-lip suction flange. Specifically, the annular self-sealing mechanism 14 comprises a seal flange 15, an annular cavity 16, a seal lip 22, and a support tube 23. The seal flange 15 is a flexible rim for the second tubular body 7 that increases the engagement surface between the present invention and the surrounding surface. Referring to FIG. 3 and FIG. 4, the seal flange 15 is positioned adjacent to the bottom end 9 of the second tubular body 7 and is laterally connected to the second tubular body 7, creating a peripheral collar on the second tubular body 7.

The annular cavity 16 is positioned concentric with the second tubular body 7 for a complete peripheral seal. The annular cavity 16 traverses into the seal flange 15, opposite the second disk top 11. Additionally, the annular cavity 16 traverses into the second tubular body 7. The annular cavity 16 is preferably positioned offset from any edge. Resultantly, this creates a U-shaped channel at the bottom surface of the second tubular body 7 and the seal flange 15. When the seal insert 6 is pushed against a surface, the bottom end 9 of the second tubular body 7 deforms inwards towards a central axis of the second tubular body 7, while the seal flange 15 deforms outwards away from the central axis of the second tubular body 7. This in turn encloses the annular cavity 16, pushes gas/air out of the annular cavity 16, and creates a partial vacuum within the annular cavity 16. The negative fluid pressure within the annular cavity 16 creates a sucking action that adheres the second tubular body 7 and the seal flange 15 to the surrounding surface. Referring to FIG. 4, it is preferred that a cross-section 17 of the annular cavity 16 is a semi-circular profile to reduce and prevent high-stress points; such that repeated deformation, attachment and detachment of the present invention, does not tear or break the second tubular body 7 and or the seal flange 15. The seal lip 22 increases the enclosed space in between the second tubular body 7, the seal flange 15 and the surrounding surface. Resultantly, the seal lip 22 increases the gripping force of the annular self-sealing mechanism 14. The seal lip 22 is a ridge that is connected to the seal flange 15. Specifically, the seal lip 22 is positioned adjacent to the annular cavity 16, opposite to the second tubular body 7. Additionally, the seal lip 22 is adjacently connected along the seal flange 15 and is oriented perpendicular to the seal flange 15.

Referring to FIG. 3, during installation of the present invention, the support tube 23 presses directly against the outer cover 1 and transfers a normal force directly onto the seal flange 15, the second tubular body 7, and the seal lip 22 from the outer cover 1. This force pushes the bottom end 9 of the second tubular body 7 against surrounding surface and engages the self-sealing mechanism 14. The support tube 23 is an elongated tubular structure with an internal diameter that is equal to or greater than the outer diameter of the first tubular body 2. The support tube 23 is concentrically positioned with the second tubular body 7, adjacent to the bottom end 9 of the second tubular body 7. Additionally, the first tubular body 2 and the second tubular body 7 are positioned within the support tube 23, wherein the first tubular body 2 is positioned in between the second tubular body 7 and the support tube 23. In order to ensure symmetric force is distributed about the seal flange 15, the support tube 23 is terminally and perimetrically connected to the seal flange 15. The outer cover 1 further comprises a support flange 5 that engages the support tube 23. The support flange 5 is positioned adjacent to the top end 8 of the second tubular body 7. Additionally, the support flange 5 is laterally connected to the first tubular body 2. The support tube 23 is sized such that the support tube 23 extends from the seal flange 15 to the support flange 5. Thus, the support flange 5 presses against the support tube 23.

Some drain vent designs include a trip lever for controlling the flow of liquid through the main drain opening. Traditionally, the trip lever is located directly on the drain vent for easy access to the user. To accommodate such designs, the outer cover 1 further comprises a first central hole 4 and the seal insert 6 further comprises a second central hole 13. The first central hole 4 is positioned concentric with the first disk top 3. Additionally, the first central hole 4 traverses normal and through the first disk top 3. Complimentary to the first central hole 4, the second central hole 13 is positioned concentric with the second disk top 11 and traverses normal and through the second disk top 11. The size and shape of the first central hole 4 and the second central hole 13 is subject to change to fit a variety of different sized trip levers. When the present invention is installed, the trip lever is positioned within the first central hole 4 and the second central hole 13. The first central hole 4 and the second central hole 13 are optional features and the present invention may be implemented without them, wherein the outer cover 1 and the second seal insert 6 are each a closed off tubular structure.

In the preferred embodiment, the present invention further comprises a check valve 18. The check valve 18 is integrated into the seal insert 6 and allows air/gas to flow out of the plumbing system of the drain vent to further create a vacuum environment within the plumbing system. Specifically, as a plunger is used on the plumbing system, air/gas within the plumbing system is pushed out through the check valve 18, thus lowering the gas pressure within the plumbing system to create a partial vacuum environment within the plumbing system. The check valve 18 is positioned within the second tubular body 7 and comprises a vent channel 19 and a deformable flap 24. The vent channel 19 puts the plumbing fixture in fluid communication with an external environment through the first central hole 4 and the second central hole 13. Specifically, the vent channel 19 traverses normal into an internal surface 10 of the second tubular body 7 and normal into a bottom surface 12 of the second disk top 11. The vent channel 19 extends from the bottom end 9 of the second tubular body 7 to the top end 8 of the second tubular body 7. Referring to FIG. 4, a first end 20 of the vent channel 19 is positioned coincident with the bottom end 9 of the second tubular body 7 and a second end 21 of the vent channel 19 is positioned coincident with the second central hole 13. When the present invention is attached to the drain vent, the internal surface 10 of the second tubular body 7 and the bottom surface 12 of the second disk top 11 press against the drain vent, closing off the vent channel 19. Due to the circular symmetrical shape of the present invention, the user is able to rotate the present invention and align the first end 20 of the vent channel 19 with a vent opening of the drain vent, allowing gas/air to flow from the plumbing system through vent channel 19.

Figure 5:
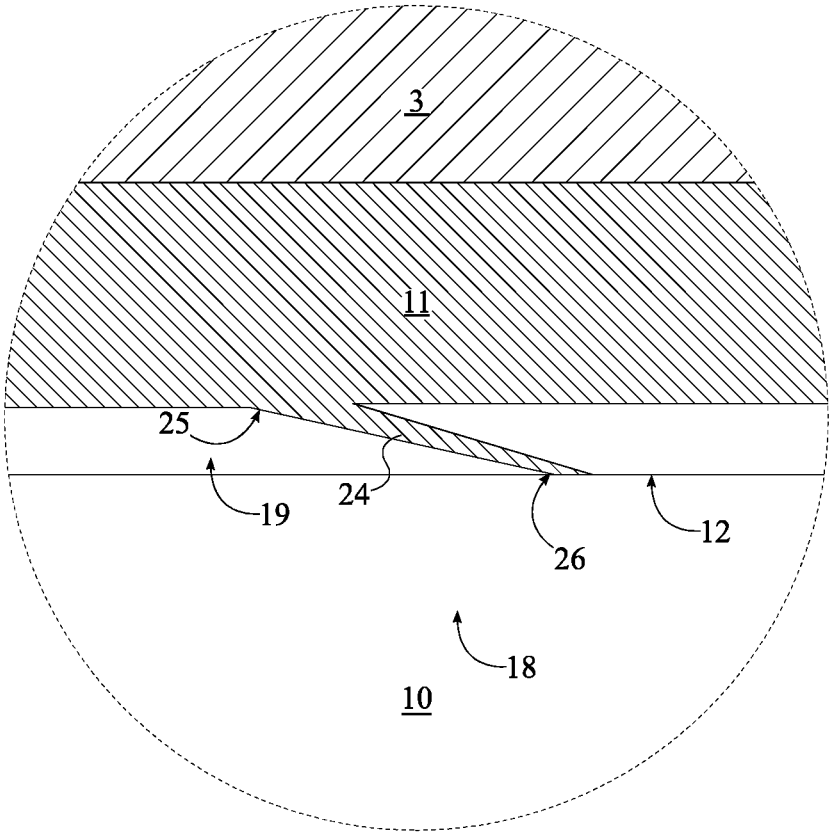
FIG. 5 is a detailed view taken about the circle 5-5 in FIG. 4.

The flow of gas/air is managed/controlled by the deformable flap 24. The deformable flap 24 allows the flow of gas/air in only one direction, i.e. out of the plumbing system. The deformable flap 24 is a thin piece of flexible material that is attached at one end. Referring to FIG. 5, the deformable flap 24 is positioned within the vent channel 19 in between the first end 20 of the vent channel 19 and the second end 21 of the vent channel 19. Additionally, the deformable flap 24 is terminally connected to the first disk top 3. The deformable flap 24 is oriented to allow gas/air flow only in one direction, i.e. from the first end 20 of the vent channel 19 to the second end 21 of the vent channel 19. For this, the deformable flap 24 is oriented along the vent channel 19 with a fixed end 25 of the deformable flap 24 being adjacently connected to the second disk top 11 while a free end 26 of the deformable flap 24 is oriented towards the second end 21 of the vent channel 19. Resultantly, on the downward stroke of the plunger, air/gas from the plumbing system will push the free end 26 of the deformable flap 24 against the second disk top 11, and thus opening the vent channel 19. On the upward stroke of the plunger, air/gas from the plumbing system will travel away from the deformable flap 24 and create negative pressure. The negative pressure will push the free end 26 of the deformable flap 24 away from the second disk top 11, closing off the vent channel 19.

In one embodiment, the present invention is designed for use on a sink. In this embodiment, the first central hole 4 and the second central hole 13 are reduced in size to act as an air expelling aperture. Resultantly, when the plunger pushes air into the piping, the air is expelled through the first central hole 4 and the second central hole 13. When the plunger is pulled upwards to create a vacuum, the check valve 18 closes and aids in creating a vacuum environment.

Although the invention has been explained in relation to its preferred embodiment, it is to be understood that many other possible modifications and variations can be made without departing from the spirit and scope of the invention.

What is claimed is:

1. A self-sealing drain vent cover comprising:
- an outer cover;
- a seal insert;
- the seal insert comprises a second tubular body, a second disk top, and an annular self-sealing mechanism;
- the second disk top being terminally and concentrically positioned with the second tubular body;
- the second disk top being perimetrically and adjacently connected to the second tubular body;
- the outer cover being mounted over the seal insert;
- the annular self-sealing mechanism being positioned adjacent to a bottom end of the second tubular body; and
- the annular self-sealing mechanism being concentrically mounted to the second tubular body.

2. A self-sealing drain vent as claimed in claim 1 comprising:
- an outer cover;
- the outer cover comprises a first tubular body and a first disk top;
- the first disk top being terminally and concentrically positioned with the first tubular body;
- the second disk top being positioned parallel and adjacent to the first disk top;
- a top end of the second tubular body being concentrically positioned within the first tubular body.

3. The self-sealing drain vent cover as claimed in claim 2 comprising:
- the outer cover further comprises a first central hole;
- the first central hole being positioned concentric with the first disk top; and
- the first central hole traversing normal and through the first disk top.

4. The self-sealing drain vent cover as claimed in claim 1 comprising:
- the seal insert further comprises a second central hole;
- the second central hole being positioned concentric with the second disk top; and
- the second central hole traversing normal and through the second disk top.

5. The self-sealing drain vent cover as claimed in claim 1 comprising:
- a second central hole;
- a check valve;
- the check valve comprises a vent channel and a deformable flap;
- the second central hole being positioned concentric with the second disk top;
- the second central hole traversing normal and through the second disk top;
- the check valve being positioned within the second tubular body;
- the vent channel traversing normal into an internal surface of the second tubular body;
- the vent channel traversing normal into a bottom surface of the second disk top;

a first end of the vent channel being positioned coincident with the bottom end of the second tubular body;

a second end of the vent channel being positioned coincident with the second central hole;

the deformable flap being positioned within the vent channel in between the first end of the vent channel and the second end of the vent channel; and the deformable flap being terminally connected to the first disk top.

6. The self-sealing drain vent cover as claimed in claim 4 comprising:

the deformable flap being oriented along the vent channel;

a fixed end of the deformable flap being adjacently connected to the second disk top; and a free end of the deformable flap being oriented towards the second end of the vent channel.

7. The self-sealing drain vent cover as claimed in claim 1, wherein the seal insert is composed of flexible material.

8. The self-sealing drain vent cover as claimed in claim 1 comprising:

the annular self-sealing mechanism comprises a seal flange and an annular cavity;

the seal flange being positioned adjacent to the bottom end of the second tubular body;

the seal flange being laterally connected to the second tubular body;

the annular cavity being positioned concentric with the second tubular body;

the annular cavity traversing into the seal flange, opposite the second disk top; and the annular cavity traversing into the second tubular body.

9. The self-sealing drain vent cover as claimed in claim 7, wherein a cross-section of the annular cavity is a semi-circular profile.

10. The self-sealing drain vent cover as claimed in claim 7 comprising:

the annular self-sealing mechanism further comprises a seal lip;

the seal lip being oriented perpendicular to the seal flange;

the seal lip being positioned adjacent to the annular cavity, opposite to the second tubular body; and the seal lip being adjacently connected along the seal flange.

11. The self-sealing drain vent cover as claimed in claim 2 comprising:

the outer cover further comprises a support flange;

the annular self-sealing mechanism further comprises a support tube;

the support tube being concentrically positioned with the second tubular body, adjacent to the bottom end of the second tubular body;

the first tubular body and the second tubular body being positioned within the support tube;

the first tubular body being positioned in between the second tubular body and the support tube;

the support tube being terminally and perimetrically connected to the seal flange;

the support flange being positioned adjacent to the top end of the second tubular body;

the support flange being laterally connected to the first tubular body; and the support flange being pressed against the support tube.

* * * * *